United States Patent [19]

Steinke et al.

[11] 4,071,132

[45] Jan. 31, 1978

[54] ENDLESS INKED RIBBON CARTRIDGE

[75] Inventors: James Marion Steinke; Justin Gaskins, both of Longwood, Fla.

[73] Assignee: TRW, Inc., Los Angeles, Calif.

[21] Appl. No.: 684,770

[22] Filed: May 10, 1976

[51] Int. Cl.[2] ..... B41J 33/10

[52] U.S. Cl. ..... 197/168; 197/151

[58] Field of Search ..... 101/336; 197/151, 168; 242/55.19 A

[56] References Cited

U.S. PATENT DOCUMENTS

| | | | |
|---|---|---|---|
| 2,499,119 | 2/1950 | Smith et al. | 242/55.19 A X |
| 3,621,968 | 11/1971 | Kondur | 197/168 X |
| 3,918,569 | 11/1975 | Parker | 197/168 |

*Primary Examiner*—Paul T. Sewell

*Attorney, Agent, or Firm*—Duckworth, Hobby & Allen

[57] ABSTRACT

An endless printer ribbon cartridge for use in printing mechanisms for computer terminals, and the like, has a housing for mounting an endless wrapped ribbon there inside. The endless ribbon is fed from the inside of the wrapped portion over a predetermined path back onto the wrapped portion. The ribbon is wrapped around a roller on one end and a slidably mounted ribbon holding member on the other in which the slidably mounted ribbon holding member is guided in a predetermined direction and is spring biased so that the wrapped endless ribbon cartridge compensates for variations or changes in ribbon length.

6 Claims, 4 Drawing Figures

ENDLESS INKED RIBBON CARTRIDGE

BACKGROUND OF THE INVENTION

The present invention relates to ribbon cartridges and especially to a cartridge for an endless inked ribbon for printing mechanisms for use with computer terminals and the like. This patent is an improvement to the assignees patent application for Endless Inked Ribbon Cartridge, Ser. No. 622,223, now U.S. Pat. No. 3,993,182 which was an improvement to the assignees patent for Endless Printer Ribbon Cartridge Apparatus, U.S. Pat. No. 3,918,569.

In the past a great many manufacturers have provided ribbon cartridges for use with their typewriters or printing mechanisms to replace the individually wrapped ribbons which must be individually threaded to the typewriter from a ribbon wrapped upon a spool to an empty spool. This in turn results in the operator's hands becoming smudged or messy during the replacement of a ribbon. Cartridge ribbons, on the other hand, may be connected from the wound spool to an empty spool and may be snapped in place with a minimum of inconvenience and time lost. A typical cartridge ribbon may operate with a preinked ribbon as well as with carbon ribbons which are destroyed once used or with ribbons that are continueously inked during the operation.

Typical prior art ribbon cartridges for typewriters or printer mechanisms may be seen in U.S. Pat. No. 3,621,968 for a ribbon cartridge with mobius loop in the ribbon which utilizes an endless ribbon through a serpentine path within a cartridge and uses a mobius loop configuration to effectively double the length of the ribbon and includes an ink pad mounted in contact with the ribbon for continueously inking the ribbon. A similar endless ribbon feeding mechanism may be seen in U.S. Pat. No. 3,755,905 in which an endless ribbon feeding device is adapted for shorthand typewriters and in U.S. Pat. No. 3,685,357 an endless ribbon feeding mechanism for typewriters is randomly looped inside a casing and fed out of the opposite end of the casing. Typewriter ribbon cartridges are also utilized for feeding from a full to an empty spool, such as illustrated in U.S. Pat. No. 3,731,781 for a Ribbon Supply Cartridge. Endless ribbon cartridges may also be seen in U.S. Pat. No. 3,726,381 and in U.S. Pat. No. 3,728,963. In addition, there have been cartridge feeding mechanisms utilized for prerecorded magnetic tapes feeding spools of plastic ribbon coated with an iron oxide or similar material past magnetic record and playback heads.

The present invention is an improvement over a previous endless printer ribbon cartridge apparatus and provides special compensation for the wide latitudes in ribbon length which results from tension stresses induced in slitting, inking or winding operations and which typically may be caused by pre-winding tension stresses or an elongation due to continual character impact.

SUMMARY OF THE INVENTION

This invention relates to an endless inked ribbon cartridge for use in printing mechanisms for computer terminals, and the like, and especially to a wrapped endless ribbon holding mechanism for a printer ribbon cartridge. A cartridge housing has a pair of spaced ribbon holding members attached thereto in which one of the holding members may be a roller rotably attached to the housing and the other holding member may be slidably mounted to the cartridge housing. The endless ribbon is wrapped around the spaced ribbon wrapping members leaving a space therebetween for feeding the ribbon from the inside of the wrapping through a predetermined path and back onto the wrapped ribbon. The slidably mounted ribbon holding member has a pair of guides for directing the holding member during any sliding and a biasing member, such as a spring, is mounted to bias the holding member against the wrapped ribbon to maintain the wrapped ribbon taut so as to compensate for changes in length in the endless ribbon.

BRIEF DESCRIPTION OF THE DRAWINGS

Other objects, features, and advantages of this invention will be apparent from the written description and drawings in which.

DESCRIPTION OF THE PREFERRED EMBODIMENT

Figure 1:
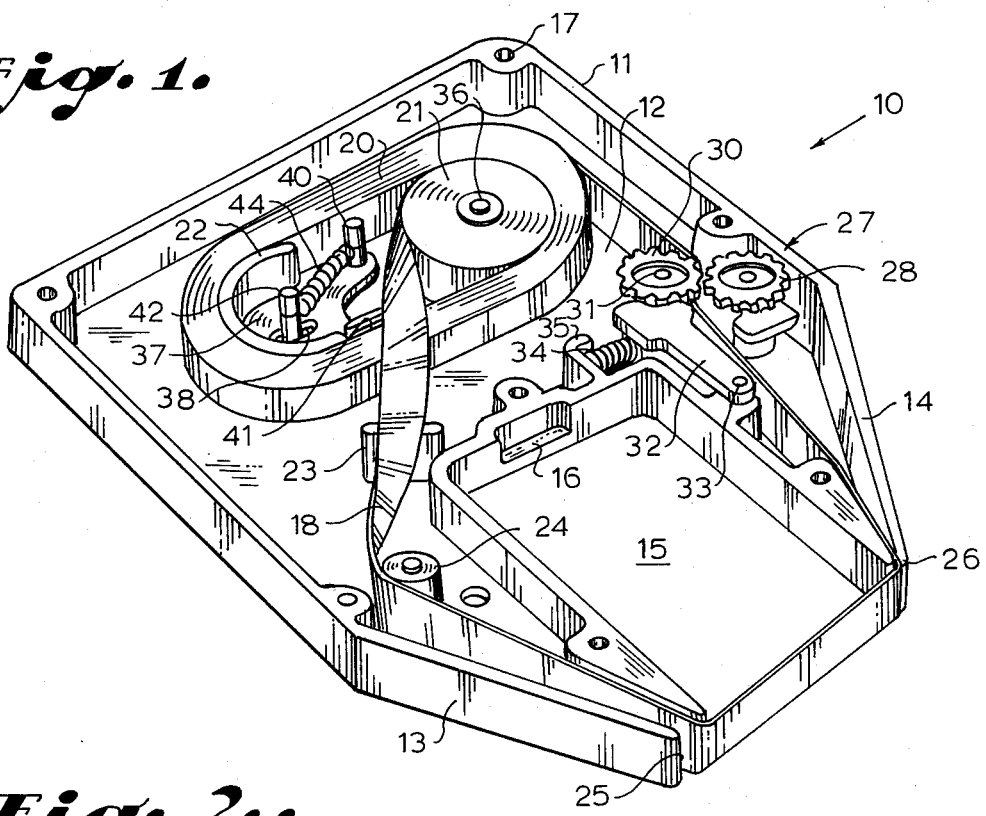
FIG. 1 is a perspective view of a cartridge in accordance with the present invention with the casing top removed.
Figure 2:
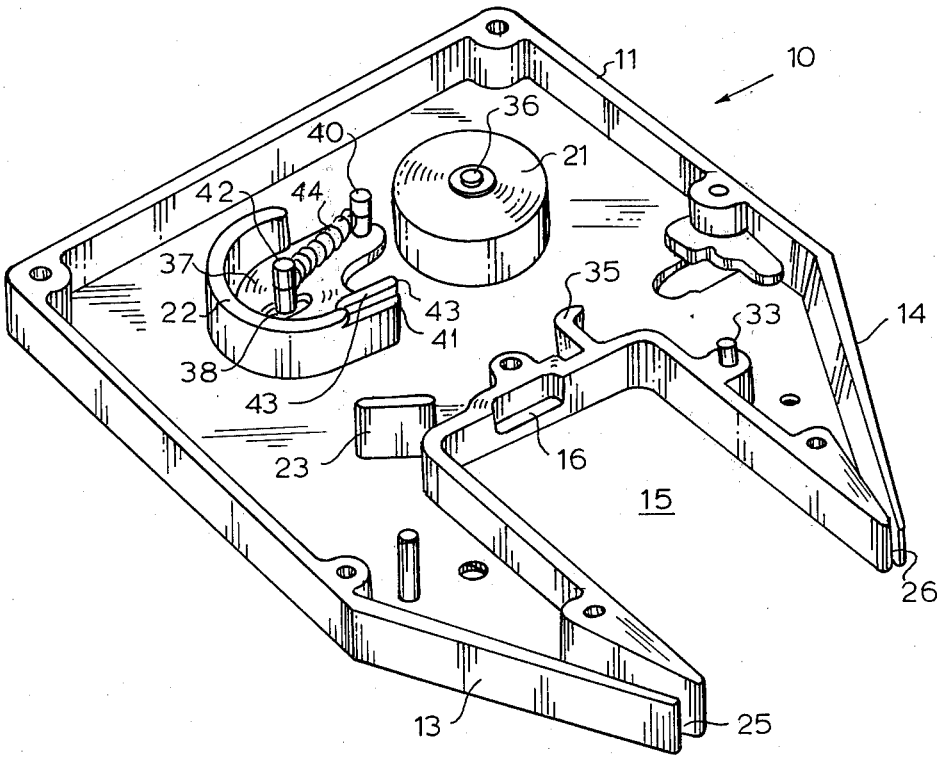
FIG. 2 is a perspective view similar to FIG. 1 with the endless ribbon guide rollers and drive mechanism removed.
Figure 3:
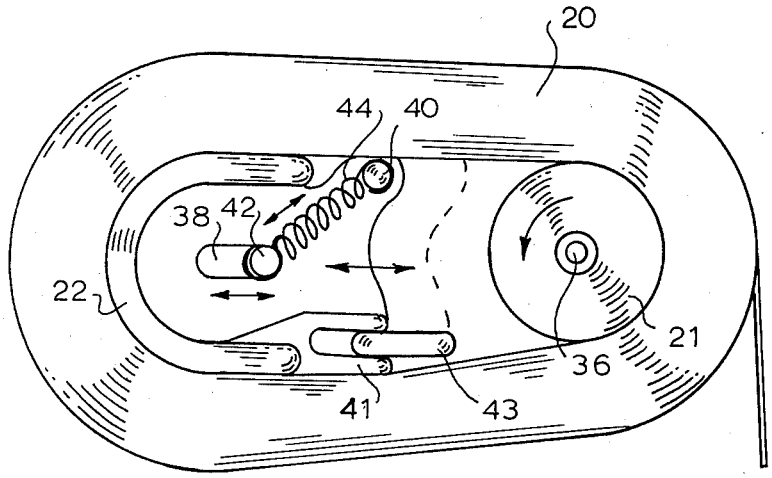
FIG. 3 is a top plan view of the wrapped endless ribbon holding mechanism with the ribbon wrapped thereon.
Figure 4:
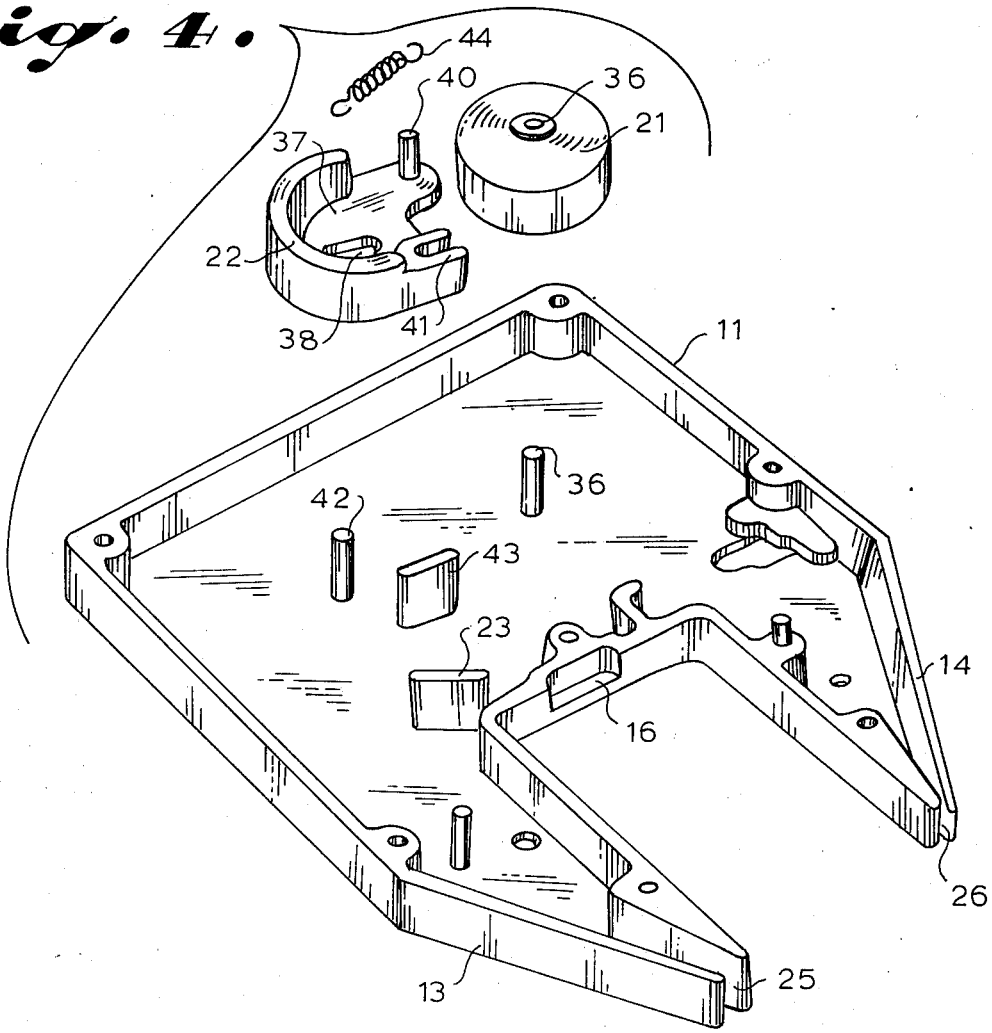
FIG. 4 is an exploded view of the casing and ribbon holding mechanism of FIG. 2.

Referring now to FIGS. 1 through 4, a preferred embodiment of an endless ribbon cartridge 10 having its top removed and having a casing or housing 11 having a base 12 and a pair of protruding arms 13 and 14 with a space 15 therebetween. The case 11 has a latching ledge 16 between the arms 13 and 14 for attaching the casing to a predetermined latching mechanism and openings 17 for attaching the top of the casing thereto. The casing 11 has an endless ribbon 18 therein and a wrapped portion 20 wrapped around the endless ribbon holding mechanism, including a roller 21 and an arcuate slider plate 22. The ribbon passes from the roller over the wrapped portion 20 over a guide member 23 and around a guide roller 24 through the arm 13 passing out of the guide opening 25 across the space 15 and into a guide opening 26 of the arm 14. The ribbon then passes through drive mechanism 27 having a drive gear 28 and a springloaded idler gear 30 rotably mounted with a pin 31 to an arm 32 which is pinned at 33 to the casing 11. A spring 34 is held by a bracket 35 formed in the casing 11 and presses against the arm 32 to bias the idler gear 30 against the drive gear 28 to drive the ribbon over an endless path when the cartridge is plugged into a terminal.

The wrapped ribbon holding mechanism has a roller 21 rotably mounted to a post 36, which may be formed in the casing 11 and may be a self-inking roller for reinking the ribbon. The present invention replaces a second roller with an arcuate slider plate or ribbon holding member 22 which has a base 37 having a central slot 38 therein, along with a spring post 40 and a yoke 41 formed on the end of the arcuate ribbon holding member 22. A post 42 is molded into the casing 11 at a predetermined location and passes through the slot 41 and guides the sliding movement of the slider plate 22. In addition, a yoke 41 fits onto a guide post member 43, which may be molded into the case 11. Yoke 41 slides on the member 43 so that the post 42 passing through the slot 38 and the guide yoke 41 sliding on the guide post 43 maintain a predetermined alignment of the ribbon holding member 22 as it slides to and away from the roller 21. A spring 44 is connected between the post 42 and a post 40 which protrudes from the base 37 of the ribbon holding member 22 so that one end of the spring 44 is connected to the ribbon holding member 22 and the other end is connected to the casing 11 post 42 to spring bias the member 22 away from the roller 21, thereby putting a bias on the wrapped portion 20 of the endless ribbon 18. Thus, lengthening of the ribbon from pre-winding tension stresses or elongation due to continual character impact or due to ribbon inking are compensated for. Since the compensation is made in the wrapped portion of the ribbon, a small sliding motion of the slider plate 22 magnifies the amount of length which can be compensated as a multiplier based on the total turns. The short movement of the slider plate can compensate for changes in the ribbon length in an amount of 5% or more.

The take-up capability of this component arrangement is predicted by the formula $L_T=2SN$ where the length take-up capacity $L_T$ is equal to twice the slot length "S " times the number of bobbin turns "N". For example, if a slot has "S", representing the allowable slider movement of the slider plate 22, of 0.150 inches and the number of turns up on the roller is 80 then the length variation which can be accommodated is two times 0.150 inches times 80 or a total of 24 inches.

It will of course be clear that other embodiments and variations are contemplated at being within the scope of those skilled in the art and that any materials or sizes may be utilized without departing from the spirit and scope of the invention. Most components may be made of a molded polymer material, except for the springs, which would typically be made of a spring steel. Accordingly, the present invention is not to be limited to the forms disclosed herein which are to be considered as illustrative rather than restrictive.

We claim:

1. An endless printer ribbon cartridge, comprising in combination:

a housing;

a roller rotably attached to said housing;

a slidably mounted ribbon holding member, having an arcuate ribbon wrapping portion and a base portion fixedly attached thereto;

guide means coupling said slidably mounted ribbon holding member to said housing for guiding said ribbon holding member in a predetermined path, said guide means having a slot in said slidably mounted ribbon holding member and a post attached to said cartridge housing and passing through said slot in said holding member;

an endless inked ribbon partially wrapped around said roller a plurality of turns and slidably mounted ribbon holding member for a plurality of turns to form a space therebetween, said ribbon having a predetermined path coming off the wrapped portion between said roller and said ribbon holding member and being fed through a predetermined path and back onto said partially wrapped portion of said ribbon; and biasing means for biasing said slidably mounted ribbon holding means against said partially wrapped portion of said ribbon, said biasing means having a spring attached to said slidably mounted ribbon holding member and to said post passing through said slot in said ribbon holding member, whereby said endless ribbon cartridge compensates for variations in ribbon length.

2. The apparatus in accordance with claim 1 in which said spring is attached to said ribbon holding member by a post protruding from said ribbon holding member.

3. The apparatus in accordance with claim 1 in which said guide means includes a yoke slidably engaging a post protruding from said housing.

4. The apparatus in accordance with claim 3 in which said yoke guide post is a flattened elongated post for maintaining the position of said ribbon holding member.

5. The apparatus in accordance with claim 4 in which said ribbon holding member has an arcuate ribbon wrapping portion and a base having a slot therein and has said post protruding from said ribbon holding member protruding from said base.

6. The apparatus in accordance with claim 1 in which said slidably mounted ribbon holding member will slide a sufficient distance to take-up approximately 5% variation in the total ribbon length.

* * * * *